US006955195B1

(12) United States Patent
Marceau et al.

(10) Patent No.: US 6,955,195 B1
(45) Date of Patent: Oct. 18, 2005

(54) BAG FILLING APPARATUS AND METHOD FOR FILLING LOOSE MATERIAL INTO A BAG

(75) Inventors: Stéphane Marceau, Rivière-du-Loup (CA); Patrick Dumont, St-Antonin (CA); Yann Gagné, St-Antonin (CA); Billy LaPointe, Rivière-du-Loup (CA)

(73) Assignee: Premier Tech 2000 Ltee, (CA)

( * ) Notice: Subject to any disclaimer, the term of this patent is extended or adjusted under 35 U.S.C. 154(b) by 0 days.

(21) Appl. No.: 10/966,442

(22) Filed: Oct. 15, 2004

(30) Foreign Application Priority Data

Apr. 26, 2004 (CA) ..... 2465185

(51) Int. Cl.[7] ..... B65B 1/04
(52) U.S. Cl. ..... 141/10; 141/313; 141/59
(58) Field of Search ..... 141/10, 114, 313–317, 141/59; 53/570–573, 284.7

(56) References Cited

U.S. PATENT DOCUMENTS

| | | | | |
|---|---|---|---|---|
| 3,707,172 | A | 12/1972 | Obara | 141/59 |
| 3,928,940 | A | 12/1975 | Fagniart | 53/112 B |
| 4,081,004 | A | 3/1978 | Harris | 141/10 |
| 4,096,894 | A | 6/1978 | Guy | 141/93 |
| 4,109,792 | A | 8/1978 | Greenawalt et al. | 206/525 |
| 4,182,386 | A | 1/1980 | Alack | 141/83 |
| 4,308,710 | A | 1/1982 | Sandberg | 53/433 |
| 4,526,214 | A | 7/1985 | McGregor | 141/59 |
| 4,537,013 | A | 8/1985 | Tetenborg et al. | 53/570 |
| 4,566,505 | A | 1/1986 | Ruf et al. | 141/83 |
| 4,648,432 | A | 3/1987 | Mechalas | 141/68 |
| 5,014,493 | A | 5/1991 | West | 53/410 |
| 5,301,492 | A | 4/1994 | Kader | 53/459 |
| 5,348,063 | A * | 9/1994 | Handleman | 141/314 |
| 5,349,996 | A | 9/1994 | McGregor | 141/314 |
| 5,375,396 | A | 12/1994 | Hiiwelmann | 53/502 |
| 5,413,157 | A | 5/1995 | McGregor | 141/314 |
| 5,466,894 | A | 11/1995 | Naef | 177/59 |
| 5,531,252 | A | 7/1996 | Derby et al. | 141/67 |
| 5,581,984 | A | 12/1996 | Domke et al. | 53/552 |
| 5,704,197 | A | 1/1998 | Gifford | 53/571 |
| 6,065,271 | A | 5/2000 | Nicastro | 53/570 |
| 6,748,723 | B2 | 6/2004 | Wadium et al. | 53/469 |
| 6,776,197 | B1 | 8/2004 | DeCrane | 141/10 |

FOREIGN PATENT DOCUMENTS

| | | |
|---|---|---|
| JP | 7033257 | 2/1995 |

* cited by examiner

*Primary Examiner*—Steven O. Douglas
(74) *Attorney, Agent, or Firm*—St. Onge Steward Johnston & Reens LLC

(57) ABSTRACT

A bag filling apparatus for packing loose material into a bag, comprising a feeding hopper for receiving the loose material and a hollow tube connected to the feeding hopper. The hollow tube comprises an upper section connected to the feeding hopper and a lower section slideably mounted around the upper section and movable between a raised position and a lower position where the lower section extends into the bag. The lower position is used upon discharge of the loose material into the bag. The apparatus comprises dust collecting means for collecting dust within the lower section of the hollow tube when the lower section is in the lower position and the bag is filled with the loose material. The apparatus further comprises means for moving the lower section of the hollow tube along a substantially vertical axis between the raised and the lower positions.

14 Claims, 9 Drawing Sheets

BAG FILLING APPARATUS AND METHOD FOR FILLING LOOSE MATERIAL INTO A BAG

This application claims priority from pending Canadian Patent Application No. 2,465,185 filed on Apr. 26, 2004.

FIELD OF THE INVENTION

The present invention relates generally to bag filling and sealing apparatuses for packing loose material. More particularly, it concerns a bag filling apparatus and method for filling loose material into a bag and reducing considerably dust emission while at the same time keeping the inside of the bag free from dust in its sealing region.

BACKGROUND OF THE INVENTION

Bag filling apparatuses for packing loose material typically use a stationary filling chute positioned over the bag ready to be filled and sealing equipment for sealing the top of the bag once it has been filled with the dusty material. The sealing of the bag is usually performed by melting a top sealing region of the bag thereby obtaining a transverse seam sealing the bag. One problem encounters with such machine is that fluffy dust tends to be ejected from the bag into the surrounding environment and also to accumulate on the inside surface of the bag. Such dust contamination come from the air draft generated when the bag is filled up with the loose material. The air draft activates the dust contained in the material as the bag is filled and allows the dust to stick on the inside surface of the bag. Since the dust generally has a higher melting point than the material from which the bag is made, typically polyethylene, the dust acts as a thermal barrier, thus affecting the seal strength. While many attempts have been made by the industry to successfully prevent dust emission and the contamination of the sealing region of a bag with very dusty materials, the problem remains unsolved.

Thus, there is still presently a need for a bag filling apparatus for filling loose material into a bag that successfully prevents dust contamination of the bag within a sealing zone.

There is also a need for a bag filling apparatus for filling loose material into a bag that successfully prevents dust emission outside the bag during and after the feeding of loose material into the bag.

Known in the art are U.S. Pat. No. 3,928,940 (Fagniart); U.S. Pat. No. 3,707,172 (Obara); U.S. Pat. No. 4,096,894 (Guy); U.S. Pat. No. 4,109,792 (Greenawalt et al.); U.S. Pat. No. 4,182,386 (Alack); U.S. Pat. No. 4,308,710 (Sandberg); U.S. Pat. No. 4,526,214 (McGreggor); U.S. Pat. No. 4,648,432 (Mechalas); U.S. Pat. No. 5,349,996 (McGreggor); U.S. Pat. No. 5,413,157 (McGreggor); U.S. Pat. No. 5,531,252 (Derby et al.); U.S. Pat. No. 5,581,984 (Domke et al.); U.S. Pat. No. 5,704,197 (Gifford); U.S. Pat. No. 6,748,723 (Wadium et al.); and Japan Patent no. 07033257, which disclose various apparatuses and methods for keeping the inside of a bag free from dust in its sealing region.

Also known in the art are U.S. Pat. No. 4,081,004 (Harris); U.S. Pat. No. 4,537,013 (Tetenborg et al.); U.S. Pat. No. 4,566,505 (Ruf et al.); U.S. Pat. No. 5,014,493 (West); U.S. Pat. No. 5,301,492 (Kader); U.S. Pat. No. 5,375,396 (Huwelmann); U.S. Pat. No. 5,466,894 (Naef); U.S. Pat. No. 6,065,271 (Nicastro); and U.S. Pat. No. 6,776,197 (De Crane), which disclose various bag filling apparatuses and methods for packing loose material.

SUMMARY OF THE INVENTION

An object of the present invention is to provide a bag filling apparatus and method for filling loose material into a bag that satisfy the above-mentioned needs.

It is also an object of the invention to provide a bag filling apparatus and method for filling loose material into a bag, adapted to prevent accumulation of dust in a sealing zone of the bag prior to sealing the same, thus providing a strong and efficient transverse seam sealing the bag.

According to the present invention, these objects are achieved with a bag filling apparatus for filling loose material into a bag, comprising a feeding hopper having an inlet for receiving the loose material and an outlet connected to a hollow tube, which extends along a substantially vertical axis. The hollow tube has an outlet to discharge the loose material from the feeding hopper into the bag. The hollow tube comprises an upper section connected to the feeding hopper and a lower section slideably mounted over the upper section. The lower section is movable between a raised position and a lower position where it extends into the bag. The lower position is used upon discharge of the loose material into the bag. The bag filling apparatus further comprises dust collecting means for collecting dust within the lower section of the hollow tube when the lower section is in the lower position and the bag is filled with the loose material. The bag filling apparatus further comprises means for moving the lower section of the hollow tube along the vertical axis between the raised and the lower positions.

According to the present invention, there is also provided a method for filling loose material into a bag, comprising the steps of:

a) providing a hollow tube connected to an outlet of a feeding hopper and extending along a substantially vertical axis, the hollow tube having an outlet to discharge the loose material from the feeding hopper into the bag, the hollow tube comprising an upper section connected to the feeding hopper and a lower section slideably mounted over the upper section and movable between a raised position and a lower position where the lower section extends into the bag, the lower position being used upon discharge of the loose material into the bag;
b) holding a bag open under the lower section of the hollow tube;
c) moving the lower section to the lower position;
d) feeding a certain amount of loose material to the feeding hoper;
e) collecting dust within the lower section of the hollow tube when the lower section is in the lower position and the bag is filled with the loose material; and
f) moving the lower section to the raised position.

BRIEF DESCRIPTION OF THE DRAWINGS

These and other objects and advantages of the invention will become apparent upon reading the detailed description and upon referring to the drawings in which.

Figure 1:
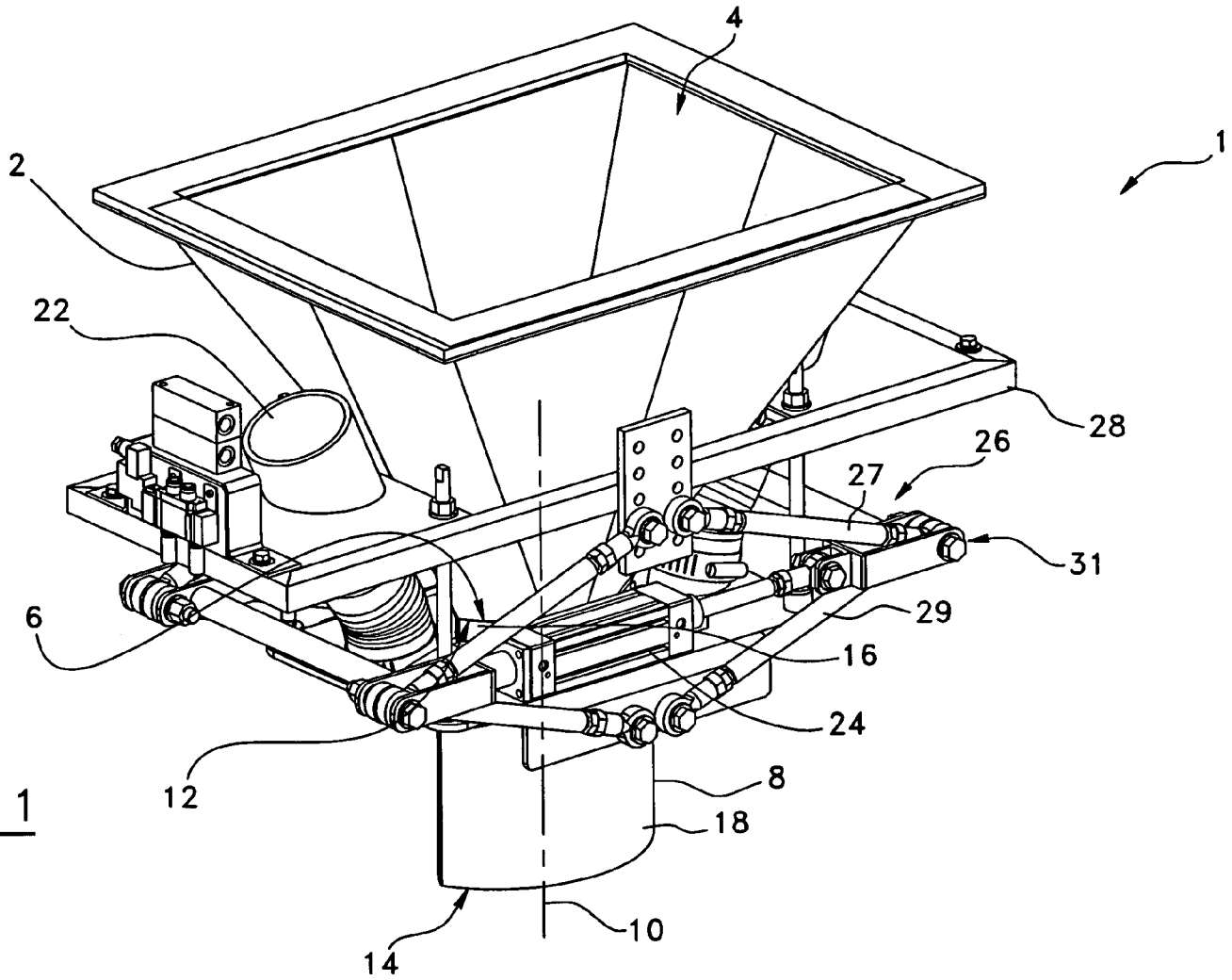
FIG. 1 is a perspective view of a bag filling apparatus according to a preferred embodiment of the present invention.
Figure 2:
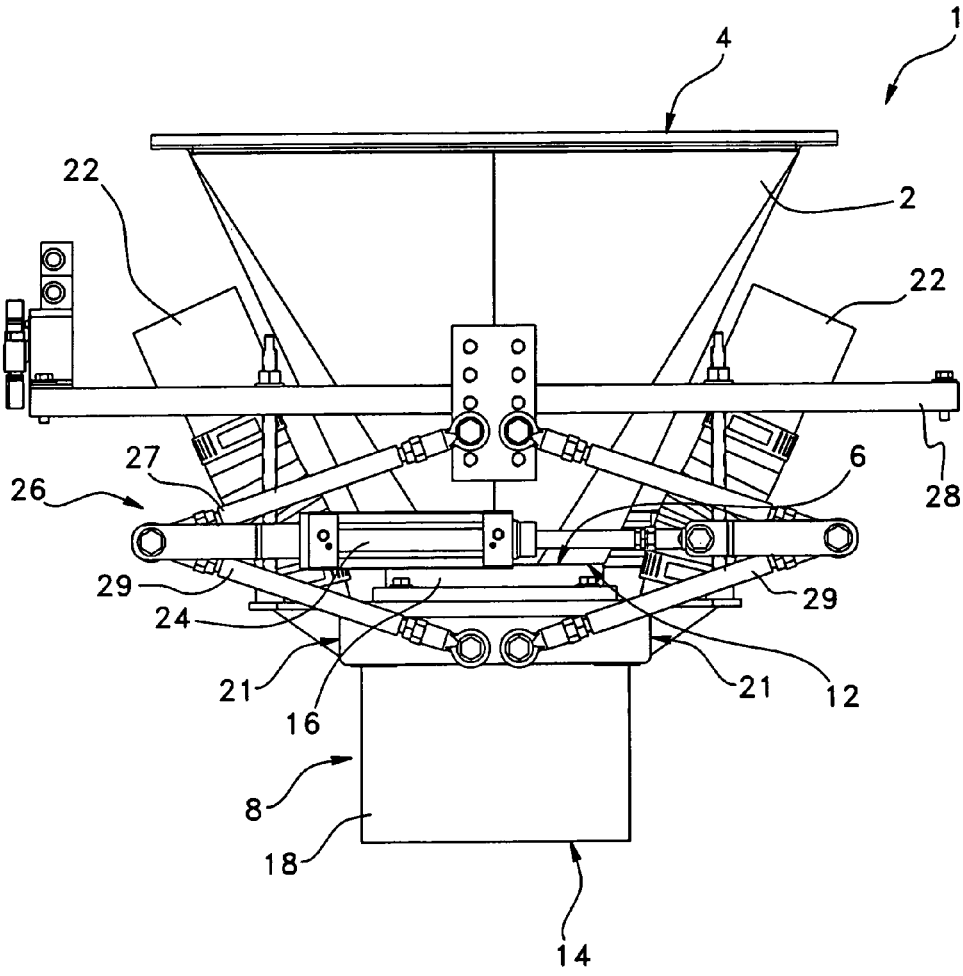
FIG. 2 is a front view of the apparatus shown in FIG. 1.
Figure 3:
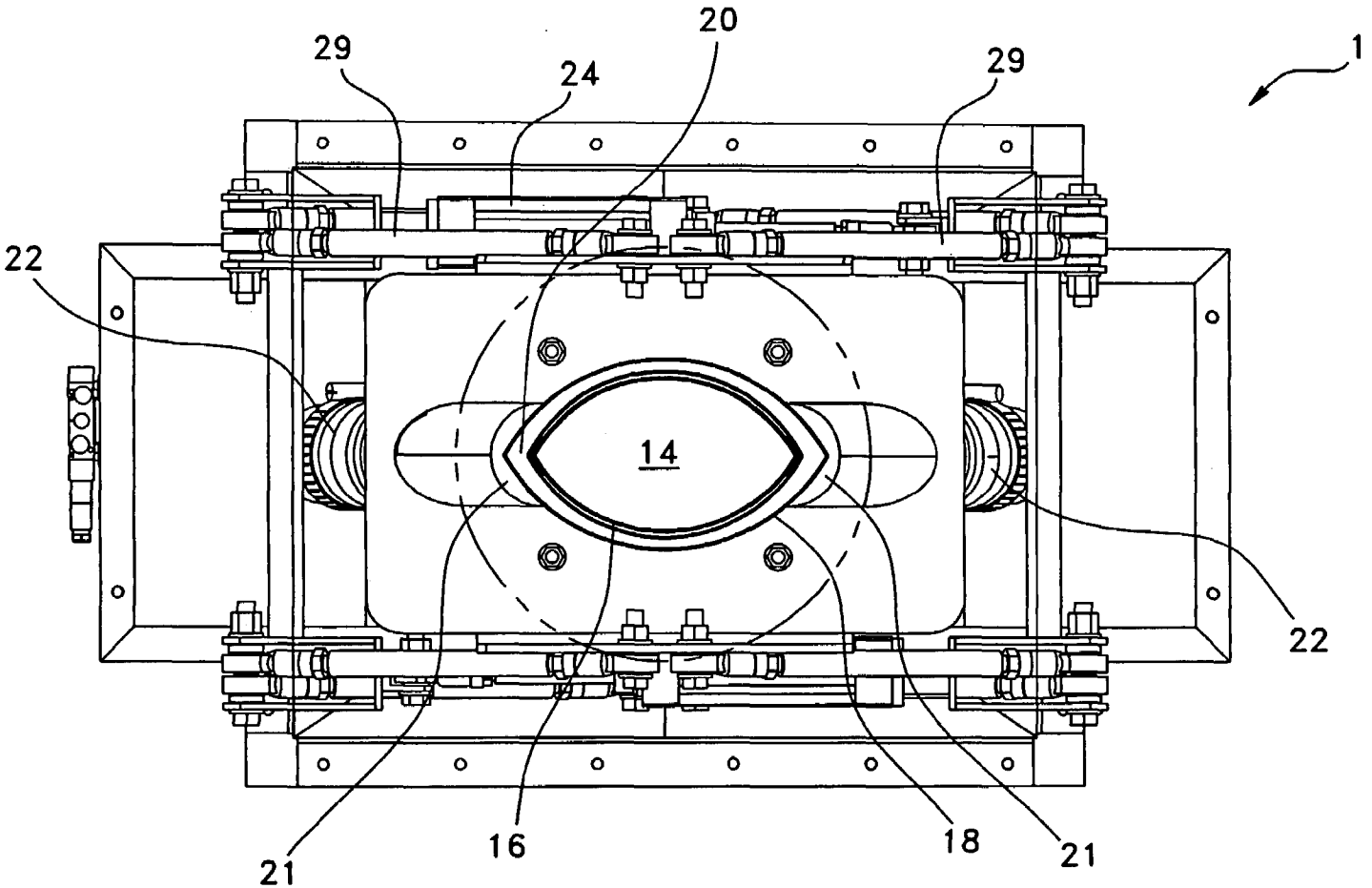
FIG. 3 is a bottom view of the apparatus shown in FIG. 1.
Figure 4:
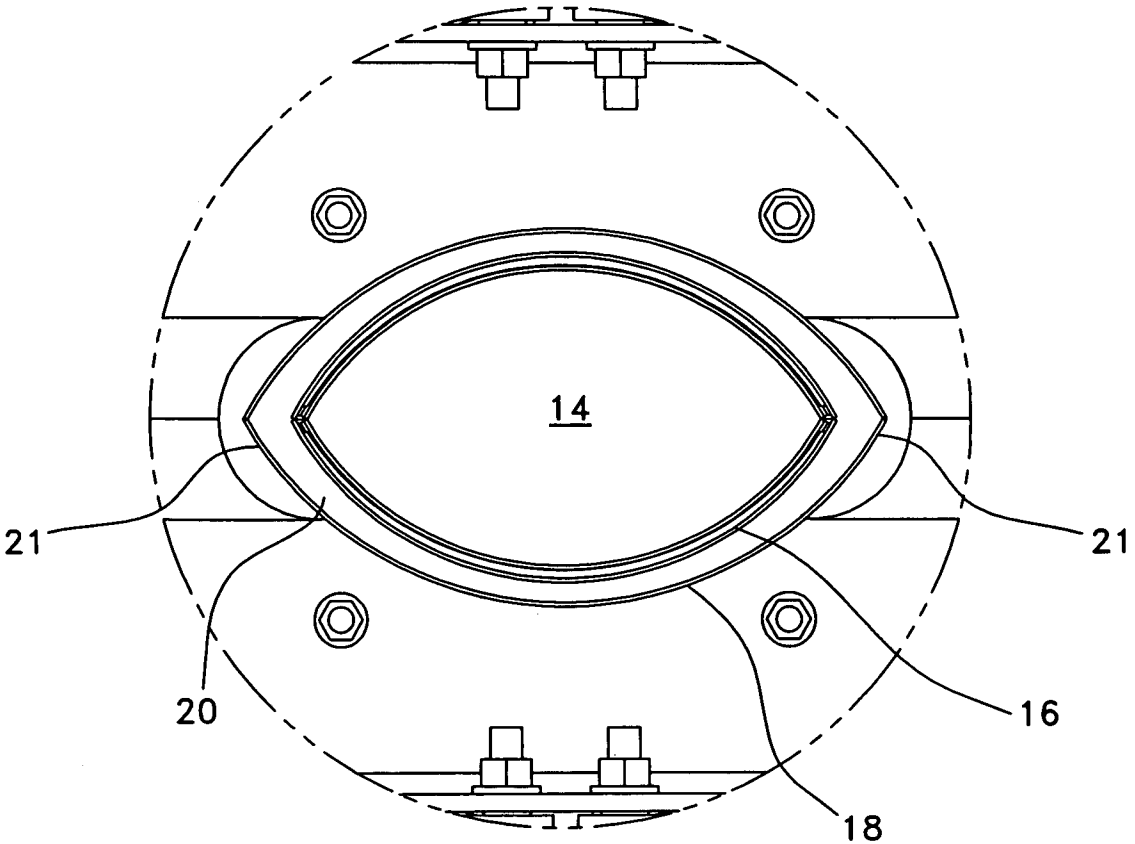
FIG. 4 is an enlarged view of the encircled region of FIG. 3.

While the invention will be described in conjunction with examples of embodiments, it will be understood that it is not intended to limit the scope of the invention to such embodiments. On the contrary, it is intended to cover all alternatives, modifications and equivalents as may be included as defined by the appended claims.

DETAILED DESCRIPTION OF PREFERRED EMBODIMENTS

In the following description, similar features in the drawings have been given similar reference numerals and in order to lighten the figures, some elements are not referred to in some figures if they were already identified in a precedent figure.

A bag filling apparatus according to the present invention is suitable for packing loose dusty material, such as concrete mix, peat moss, etc. into a bag which is preferably made of a thermoplastic material such as polyethylene. It may conveniently be used with any suitable sealing apparatus known in the art.

As mentioned above, the apparatus is provided with a dust collecting system for collecting the dust that may be emitted into the environment or accumulate on the inner walls of the bag. The dust collecting system is used prior to performing the sealing operation of the bag and prevent dust contamination of the bag within a sealing zone. The bag filling apparatus is thus preferably installed close to a bag setting station (not shown) and a sealing station (not shown). Although not illustrated, both the bag setting station and the sealing station may be provided by the bag filling apparatus. Prior to performing the feeding operation by which the loose material is fed into the bag, a bag is placed and held open under the apparatus 1 at the bag setting station.

Figure 5:
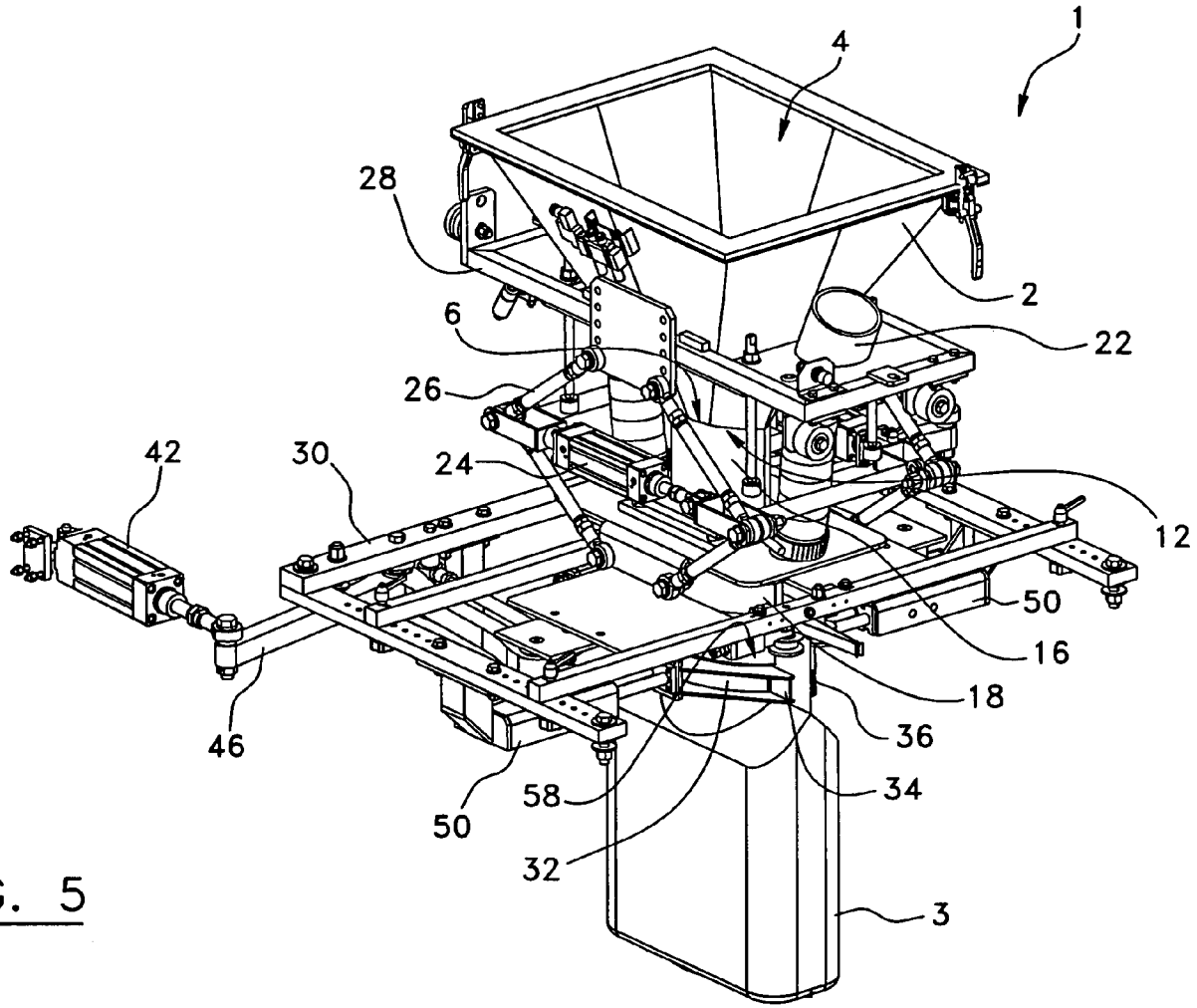
FIG. 5 is a perspective view of a bag filling apparatus according to another preferred embodiment of the present invention.

Referring to either one of FIG. 1 or 5, the bag filling apparatus 1 comprises a feeding hopper 2 having an inlet 4 for receiving loose dusty material to be filled into a bag and an outlet 6. Preferably, the feeding hopper 2 is stationary. A hollow telescopic tube 8 is mounted around the outlet 6 of the feeding hopper 2 and extending therefrom along a substantially vertical axis 10. The hollow telescopic tube 8 is used to orient the loose material into a bag 3 (as shown in FIG. 5) held open under the apparatus 1. The telescopic tube 8 has an inlet 12 connected to the outlet 6 of the feeding hopper 2 and an outlet 14 to discharge the loose dusty material into the bag 3. More specifically, the telescopic tube 8 has an upper tubular section 16 and a lower tubular section 18 overlapping the upper section 16. The lower section 18, which is preferably concentric to the upper section 16, is slideable along the upper section 18 between a raised position and a lower position, allowing the lower section 18 to get down into the bag during the filling process. The upper and lower sections 16, 18 are in a spaced apart relationship, thereby leaving an annular space there between. The annular space is closed at the top end of the lower section 18, and is used as a dust collecting area 20, as described below.

The lower section 18 has two ports 21 connected to the dust collecting area 20 for collecting dust when the bag is filled. Although two ports 21 are shown in the Figures, only one port 21 may be sufficient. As illustrated, a dust collecting duct 22 is connected to each of the ports 21. The dust collecting ducts 22 are preferably flexible and may be operatively connected to a vacuum system (not shown).

The apparatus 1 further comprises a frame 28 extending substantially at the level of the feeding hopper 2 and a scissor lift assembly 26 mounted to the frame 28 for moving the lower section 18 from its raised position to its lower position. The scissor lift assembly 26 is used to actuate the same. The scissor lift assembly 26 comprises at least an upper rod 27 pivotally connected to a lower rod 29 by means of a swivel pin 31. The upper rod 27 is secured to the frame 28 whereas the lower rod 29 is secured to the lower section 18 of the telescopic tube 8. A pneumatic 24 (or hydraulic cylinder) is provided for opening and closing the scissor lift assembly 26, thereby raising or lowering the lower section 18 of the telescopic tube 8.

In the preferred embodiments illustrated, the scissor lift assembly 26 comprises two pairs of upper and lower rods facing each other, and one pneumatic cylinder 24 interconnecting the swivel pins 31 of each pair.

Also preferably, and as illustrated in the Figures, the apparatus comprises two scissor lift assemblies 26, one on each side of the feeding hopper 2.

Any other suitable assembly for moving the lower section from its raised position to its lower position may be used instead for that purpose.

The lower section 18 of the hollow tube 8 is moved to its lower position when the bag 3 is held open under the telescopic tube 8 and is ready to be filled up. When the bag 3 is filled up, the lower section 18 stays down and the vacuum system, through the dust collecting area 20 and the dust collecting ducts 22, removes the dust in the lower section 18, thus indirectly removing dust near a top sealing section of the bag 3. The zone of the bag 3 to be sealed is therefore protected from contamination by dust. The lower section 18 is retracted when the dust is removed. Then, the top end of the bag 3 is sealed at the sealing station by any conventional sealing means known in the prior art.

Figure 6:
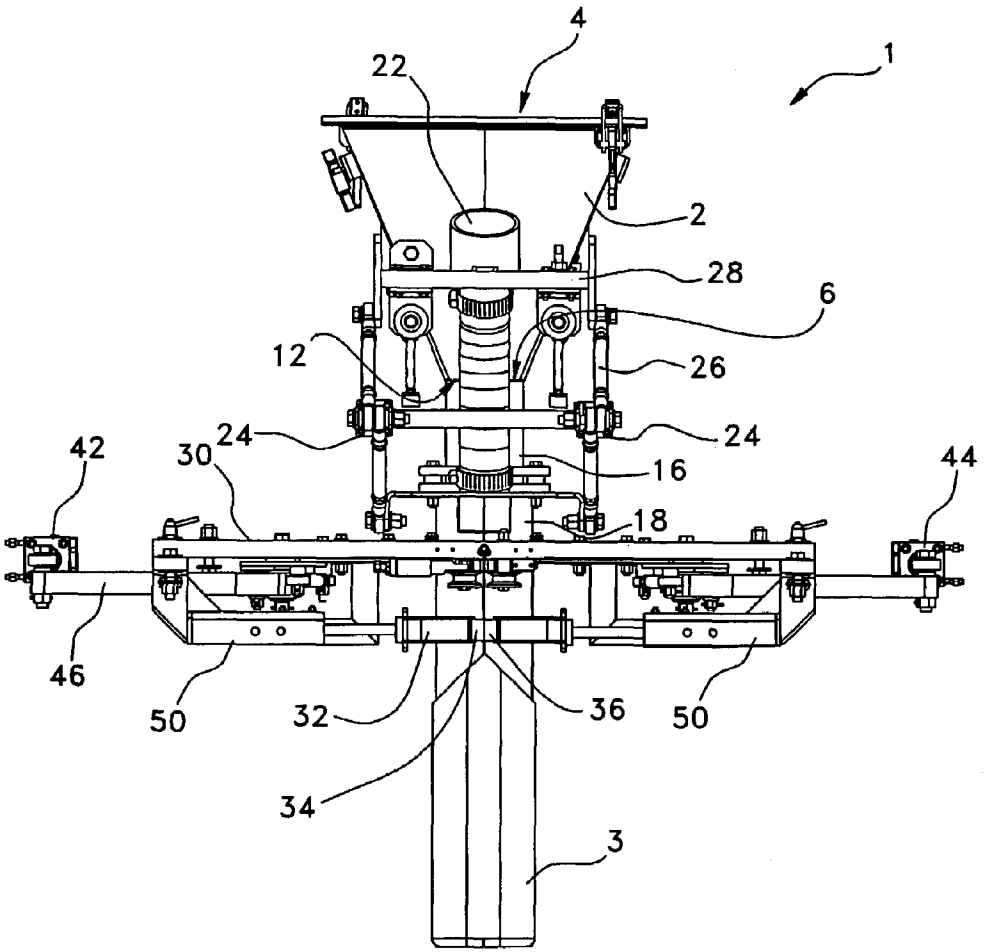
FIG. 6 is a side view of the apparatus shown in FIG. 5.
Figure 7:
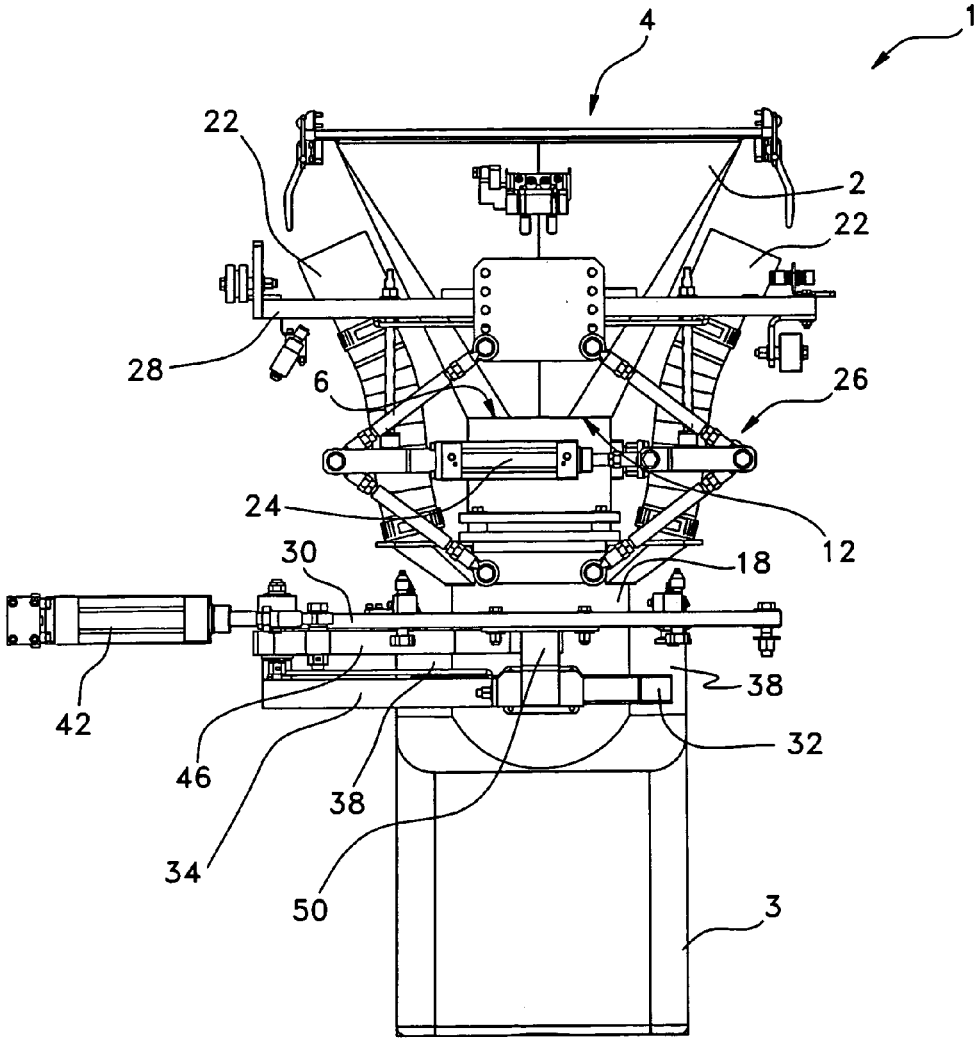
FIG. 7 is a front view of the apparatus shown in FIG. 5.

In accordance with another preferred embodiment of the invention and referring to FIGS. 5 to 7, the bag filling apparatus further comprises a closing device 32 for closing the bag 3 over the lower section 18 of the hollow tube 8, thereby preventing dust emission outside the bag 3 during the feeding operation and improving the protection of the inner walls of the bag against dust accumulation.

Preferably, the closing device 32 is a removable collar being shaped to mate with the lower section 18 to insure a tight seal of the bag 3 around the lower section 18. The collar 32 may comprise two brackets 34, 36 movable between a first position (as shown in FIGS. 5 to 7) where the brackets 34, 36 tighten the bag 3 over the lower section 18 and a second position (not shown) where the brackets 34, 36 are positioned away from the lower section 18. As better shown in FIG. 7, the brackets 34, 36 are used to close the upper portions 38 of the bag 3 on the lower section 18 to prevent dust emission, thus increasing efficiency of the dust removing process. The brackets 34, 36 are moveable between the first and second positions by means of actuators 50 mounted on another frame 30, hereinafter referred to as the lower frame 30, which extends generally at the level of the lower position of the lower section 18. When the filling process is completed and the dust removed, the brackets 34, 36 are retracted away from the lower tube 18 for a next bag 3 to be held open under the telescopic tube 8.

Preferably, the surface 58 of the brackets 34, 36 which comes in contact with the bag 3 when the lower section 18 is in the lower position is covered by a soft coating, such as rubber to prevent damage to the bag 3.

Figure 8:
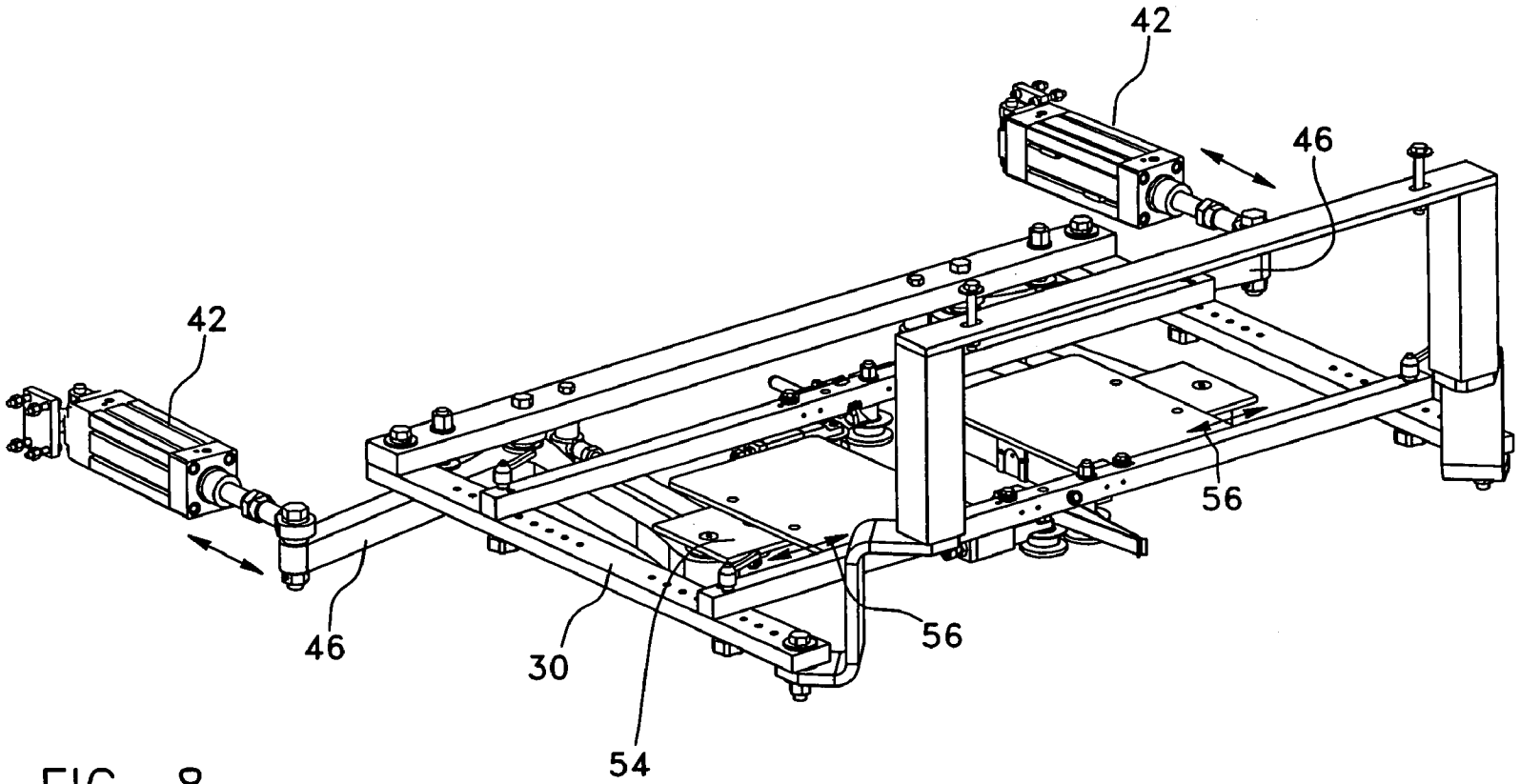
FIG. 8 is a perspective view of a bag opening device used with the bag filling apparatus shown in FIG. 5, with some elements removed for clarity.
Figure 9:
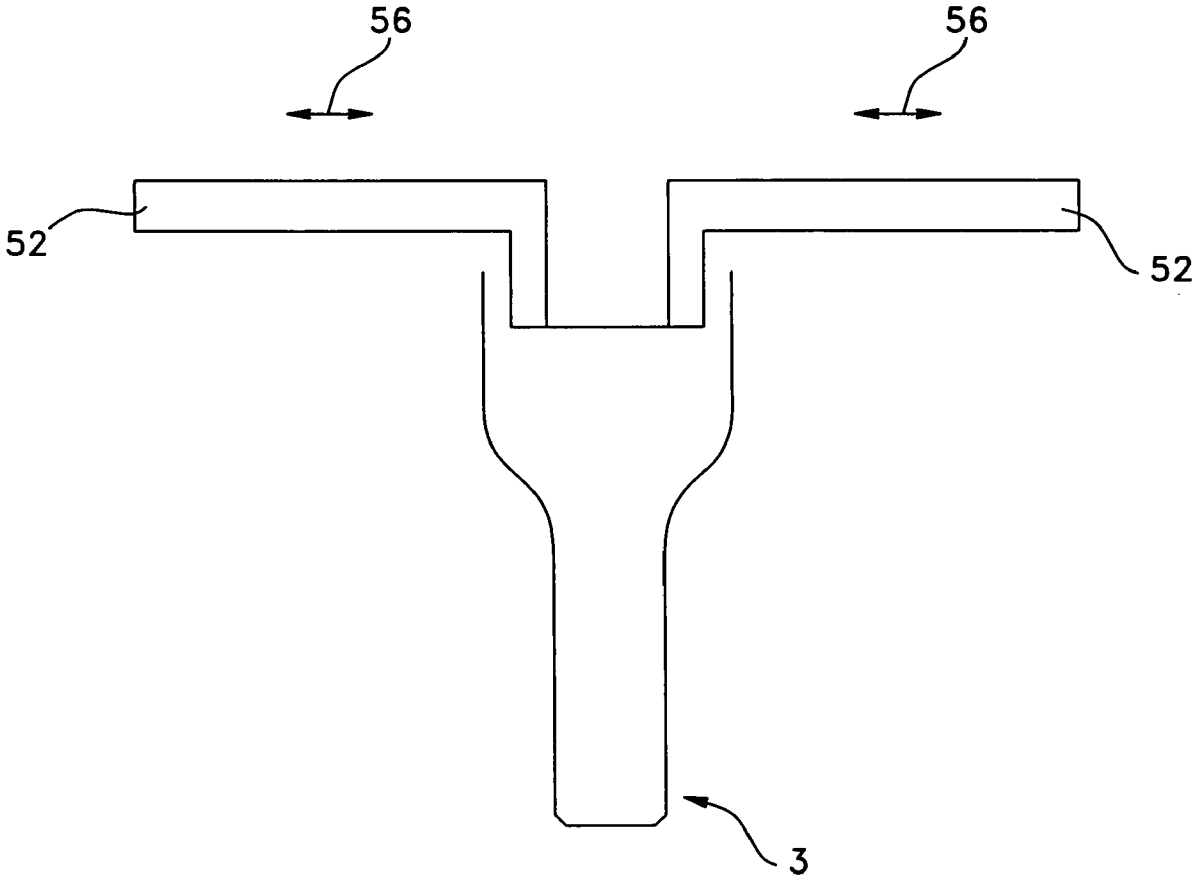
FIG. 9 is a side view of a bag being held by two skids for use with the bag opening device shown in FIG. 8.

Now turning to FIGS. 8 and 9 in order to keep the bag open under the telescopic tube 8, a bag opening device is preferably mounted to the lower frame 30. The top of the bag 3 is secured to skis 52 which move the bag 3 along a skid platform (not shown) to the bag setting station. At the bag setting station, the skis 52 are fixed to two supports 54. Each of the supports 54 extends on one side of the lower section 18 and is movable along arrow 56 by means of guiding arms 46 controlled by actuators 42, thereby opening or closing the bag 3. Of course, any other suitable bag opening device may be used instead.

While embodiments of this invention have been illustrated in the accompanying drawings and described above, it will be evident to those skilled in the art that changes and modifications may be made therein without departing from the essence of this invention.

What is claimed is:

1. A bag filling apparatus for filling loose material into a bag, comprising:

a feeding hopper having an inlet for receiving the loose material and an outlet;

a hollow tube connected to the outlet of the feeding hopper and extending along a substantially vertical axis, the hollow tube having an outlet to discharge the loose material from the feeding hopper into the bag, the hollow tube comprising an upper section connected to the feeding hopper and a lower section slideably mounted around the upper section and movable between a raised position and a lower position where the lower section extends into the bag, the lower position being used upon discharge of the loose material into the bag;

dust collecting means for collecting dust within the lower section of the hollow tube when the lower section is in the lower position and the bag is filled with the loose material; and means for moving the lower section of the hollow tube along the vertical axis between the raised and the lower positions.

2. The bag filling apparatus according to claim 1, comprising closing means adjacent to the lower section of the hollow tube for closing the bag over the lower section of the hollow tube when the lower section is in the lower position.

3. The bag filling apparatus according to claim 2, wherein said closing means comprise a removable collar shaped to mate with the lower section of the hollow tube.

4. The bag filling apparatus according to claim 3, wherein the collar comprises:

at least two brackets movable between a first position where the brackets close the bag over the lower section of the hollow tube and a second position where the brackets are positioned away from the lower section of the hollow tube; and actuators to control a movement of said brackets between the first and the second positions.

5. The bag filling apparatus according to claim 4, wherein each of said brackets have a surface which is in contact with the bag when the lower section is in the lower position, said surface being covered with a soft coating.

6. The bag filling apparatus according to claim 1, wherein the lower section comprises at least one port and the dust collecting means comprise at least one dust collecting duct having a first end connected to the at least one port and a second end operatively connected to a vacuum system.

7. The bag filling apparatus according to claim 1, comprising a frame extending substantially at the level of the feeding hopper and wherein said means for moving the lower section of the hollow tube along the vertical axis comprise a scissor lift assembly mounted to the frame for moving the lower section from its raised position to its lower position.

8. The bag filling apparatus according to claim 7, wherein said scissor lift assembly comprises a pneumatic cylinder for opening and closing the scissor lift assembly, thereby raising or lowering the lower section of the hollow tube.

9. The bag filling apparatus according to claim 8, wherein said scissor lift assembly comprises at least an upper rod pivotally connected to a lower rod by means of a swivel pin, the upper rod being secured to the frame whereas the lower rod being secured to the lower section of the hollow tube.

10. The bag filling apparatus according to claim 9, wherein said scissor lift assembly comprises two pairs of said upper and lower rods facing each other, the pneumatic cylinder interconnecting the swivel pins of each pair.

11. The bag filling apparatus according to claim 7, wherein said scissor lift assembly comprises two of said scissor lift assembly, one scissor lift assembly on each side of the feeding hopper.

12. The bag filling apparatus according to claim 1, wherein the lower section is concentric to the upper section and the upper and lower sections form together an annular space that is closed at a top end of the lower section.

13. A method for filling loose material into a bag, comprising the steps of:

a) providing a hollow tube connected to an outlet of a feeding hopper and extending along a substantially vertical axis, the hollow tube having an outlet to discharge the loose material from the feeding hopper into the bag, the hollow tube comprising an upper section connected to the feeding hopper and a lower section slideably mounted over the upper section and movable between a raised position and a lower position where the lower section extends into the bag, the lower position being used upon discharge of the loose material into the bag;

b) holding a bag open under the lower section of the hollow tube;

c) moving the lower section to the lower position;

d) feeding a certain amount of loose material to the feeding hoper;

e) collecting dust within the lower section of the hollow tube when the lower section is in the lower position and the bag is filled with the loose material; and f) moving the lower section to the raised position.

14. The method according to claim 13, further comprising the step of closing the bag over the lower section prior to the step of feeding.

* * * * *